United States Patent [19]

Cadwell et al.

[11] Patent Number: 4,687,729

[45] Date of Patent: Aug. 18, 1987

[54] LITHOGRAPHIC PLATE

[75] Inventors: Donald E. Cadwell, St. Paul; Larry A. Brey, Woodbury, both of Minn.

[73] Assignee: Minnesota Mining and Manufacturing Company, St. Paul, Minn.

[21] Appl. No.: 791,602

[22] Filed: Oct. 25, 1985

[51] Int. Cl.[4] ..... G03C 1/76

[52] U.S. Cl. ..... 430/271; 430/276; 430/302; 101/463.1

[58] Field of Search ..... 430/271, 275, 276, 302; 101/463.1

[56] References Cited

U.S. PATENT DOCUMENTS

| | | | |
|---|---|---|---|
| 3,248,249 | 4/1966 | Collins, Jr. | 106/286 |
| 3,248,250 | 4/1966 | Collins, Jr. | 106/286 |
| 3,248,251 | 4/1966 | Allen | 106/286 |
| 3,962,490 | 6/1976 | Ward | 427/193 |
| 4,208,223 | 6/1980 | Hofstatter | 148/6.2 |
| 4,238,534 | 12/1980 | Ichida et al. | 427/376.5 |
| 4,371,430 | 2/1983 | Ballarini et al. | 204/32 R |
| 4,420,549 | 12/1983 | Cadwell | 430/158 |
| 4,431,724 | 2/1984 | Ovchinnikov et al. | 430/302 |
| 4,445,998 | 5/1984 | Kanda et al. | 264/385 |
| 4,457,971 | 7/1984 | Cadwell et al. | 428/323 |
| 4,522,891 | 6/1985 | Iwaki et al. | 428/626 |
| 4,522,912 | 6/1985 | Sharkozy et al. | 430/278 |

FOREIGN PATENT DOCUMENTS

| | | |
|---|---|---|
| 1057111 | 6/1979 | Canada . |
| 0097502 | 1/1984 | European Pat. Off. . |
| 0097503 | 1/1984 | European Pat. Off. . |
| 0098166 | 1/1984 | European Pat. Off. . |
| 0098776 | 1/1984 | European Pat. Off. . |
| 0115433 | 8/1984 | European Pat. Off. . |

*Primary Examiner*—John E. Kittle
*Assistant Examiner*—José G. Dees
*Attorney, Agent, or Firm*—Donald M. Sell; James A. Smith; David L. Weinstein

[57] ABSTRACT

Printing plates made from ceramic-coated, steel-based, lithographic plate precursors. The printing plate of this invention is a lithographic plate comprising a steel substrate, an adhesion promoting layer overlying the steel substrate, a ceramic layer overlying the adhesion promoting layer, and a photosensitive layer coated over the ceramic layer. The steel-based plate is more durable than aluminum based plates.

25 Claims, No Drawings

LITHOGRAPHIC PLATE

This invention relates to printing plates, more particularly, ceramic-coated, steel-based, lithographic plate precursors.

Aluminum has usually been used as the support for lithographic printing plate materials. However, it is expensive and it may sometimes suffer from cutting during printing because it is flexed at an acute angle when mounted on a printing machine. European Patent Publication No. 20021 discloses a less expensive steel support comprising an electrodeposited chromium layer on a steel plate characterized by an effective absence of generally planar exterior surfaces and relatively sharp protuberant angles. However, this support does not adhere sufficiently to the image portions and, when employed for a lithographic printing plate, the image line portion may be partially peeled off during printing, ink spreading may develop at dots portion, scumming may develop at the non-image portions, or printing life may not be sufficient. Also, because of the narrow tolerance in developing, there is practiced the so-called "hand processing" method in which development is performed by rubbing the plate with a sponge impregnated with a developer without use of an automatic developing machine. However, damages are liable to occur at the image portions.

Offset printing plates having an aluminum substrate have an insufficient mechanical strength due to a low mechanical strength of an aluminum substrate (tensile strength is 14 to 20 kgf/cm$^2$). This restricts the field of application of these offset printing plates on certain kinds of printing equipment, especially web presses. Furthermore, non-printing areas made of oxidized aluminum have a relatively low wear-resistance (the volume of ground-off material from a unit area of a non-printing area is 0.18 mm$^3$/cm$^2$). This lowers the press life of offset printing plates which, for aluminum-based offset plates, usually does not exceed 100,000 prints.

Recently, in order to overcome these drawbacks, proposals were made about supports for lithographic printing plates having an electrodeposited chromium or a chromium-chromium oxide layer onto an iron material (Japanese Unexamined Patent Publications Nos. 145193/1980 and 162692/1981). However, in these techniques, hydrophilicity of the support or adhesion between the support and the photosensitive layer are insufficient, and therefore, when employed as a lithographic printing plate, printing ink may be adhered onto the non-image portion (where scumming generates) or a part of the image portion may be peeled off during printing for a long term, thus resulting in poor printing life. Also, it has been proposed to obtain a support for lithographic printing plate by treating the surface of a steel treated with chromic acid with an aqueous zirconic fluoride solution or an aqueous or alcoholic solution of a hydrophilic resin to make it hydrophilic (Japanese Patent Publication No. 31277/1981).

Known in the art are processes for the manufacture of the above-mentioned offset printing plates involving preparation of the surface of a steel substrate and build-up of copper and chromium layers thereon. The substrate preparation comprises electrochemical (for steel) methods, followed by application, thereon of an interlayer to insure the required adhesion of the subsequent layers. Then onto the prepared substrate there are deposited, electrolytically, first a copper and then a chromium layer to a predetermined thickness using electrolytes having a multi-component composition. Onto the thus-produced multi-metal plate there is deposited a light-sensitive top layer comprising PVA or a photopolymerizable composition. Then the top layer is dried and an image is transferred thereon from a diapositive. The image is developed, whereby the untanned regions of the top layer are removed. The uncovered regions of the multi-metal plate are etched (chemically or electrochemically), to the underlying copper layer. Then the tanned regions are removed from the top layer chemically or electrochemically to reveal chrome regions. Then copper printing areas are rendered hydrophobic and chromium non-printing areas are rendered hydrophilic using appropriate solutions.

The problems that arise from using steel for a commercial, presensitized lithoplate precursor include creating a barrier between the metal and the photosensitive image material that is sufficiently inert and a sufficiently competent barrier to interaction between the metal and the image material, to give shelf stability for about a year. This means that the plate precursor must have substantially the same response to exposure to an image, and automated development, after a year on the shelf, as it had when freshly coated. A second problem is that the elaborate and costly processes in the art for obtaining a satisfactorily textured, wear-resistant, and hydrophilic surface on the steel, nullify the cost and convenience of the steel as compared to aluminum.

The standard non-aluminum metallic lithographic plate is the bimetal or trimetal plate. These have copper deposited as the ink-receptive material, over the water-receptive material, generally stainless steel (bimetal), or chromium plated onto plain steel (trimetal). The stainless steel alloy may be of the ferritic type, which is ferromagnetic. The customer exposes the piece of image-coated steel to a transparency, then inserts it into a developing machine, which successively develops the resist layer, exposing bar chromium or stainless steel imagewise, then deposits copper on the areas of exposed metal but not on the remaining resist, rinses the plate, removes the remaining resist, and, possibly, gums the plate and dries it. This also would give a steel-backed lithoplate, of the bimetal type. Problems with these plates involve the developers and etchants. The developers are noxious aqueous solutions, and the etchants are strong acids or metal cyanides that present serious disposal problems to the printer. Steel-based photolithographic plates having nonmetallic images are the subject of a number of patents. European Patent office publications Nos. 0 097 502 and 0 097 503, disclose the use of thin steel for a photolithographic plate. It requires the use of a plated chromium layer having unique properties, which can only be applied by the specialized manufacturer of photolithographic plates. U.S. Pat. No. 4,431,724, discloses a steel lithoplate in which the steel is immersed in a rust inhibitor such as sodium nitrite, then coated directly over the thin reaction layer of inhibitor, with a standard positive or negative-working photoactive coating. This coating presumably must be exposed and developed immediately, as a so-called "wipe-on" lithographic plate, since it would not be expected to have satisfactory shelf stability as a commercial lithographic plate precursor. In order to obtain adequate run length for even marginal applications, it is developed additively: that is, the developer must contain organic compounds that adhere to the image and give it additional thickness. The steel background must then be hydrophilized with a ferrocyanide, ferricyanide, or cobaltocyanide, that is to say, with a deadly poison. This would offer the same disadvantages as bimetal or trimetal plates, without the advantage of very long press life afforded by such plates.

U.S. Pat. No. 4,445,998, to Kanda et al, is for an article which can have a steel substrate, but which requires more costly, and complex, and less effective, means than ceramic coating in order to obtain a lithographic surface. In summary, there appears to be great interest in obtaining satisfactory lithographic performance from steel, but no method of obtaining it that has the all-around suitability for general lithographic applications.

SUMMARY OF THE INVENTION

This invention involves a lithographic plate comprising a steel substrate, an adhesion promoting layer overlying the steel substrate, a ceramic layer overlying the adhesion promoting layer, said ceramic layer overcoated with a photosensitive layer.

The presence of the adhesion promoting layer is critical. The ceramic layer used in the lithographic plate of this invention will adhere to plated steel, wherein the plate material acts as the adhesion promoter, or to low carbon steel, wherein the adhesion promotor is an aqueous inorganic surface treatment composition.

The advantages of a steel substrate for ceramic coating are physical. Coated steel can be fired at a considerably higher temperature than aluminum. This broadens the range of coating formulations that may be used to include some with greater inherent abrasion and chemical resistance than those that can be used with aluminum. It is developable in standard equipment with non-noxious aqueous developers. It is more durable than aluminum based plates. It can also be made to adhere to printing press rolls by magnetic attraction.

DETAILED DESCRIPTION

The substrate can be any conventional steel available in width, caliper, and surface quality suitable for a lithographic printing press, such as a carbon steel having low amounts of elements other than carbon, plated steel, or alloy steel. It has been discovered that the steel substrate must bear a surface film to promote adhesion of the ceramic coating to steel. In the case of some particular plated or alloy steels, the surface film is generally present. For example, chromium plated steels, such as chromium coated tin mill black plate, and conventional 12 weight percent chromium stainless alloy steels have, after conventional alkali cleaning for removal of soil and protective oil, a natural chromium oxide film that promotes adhesion of a ceramic coating. In the case of low carbon steel, an adhesion promoter must be applied to the substrate in order to adhere the ceramic to the steel. In the absence of adhesion promoter, the ceramic coating will be converted to dust upon firing and will subsequently flake off the substrate. Adhesion promoters that have been found to be useful for the present invention include such functional coatings as rust inhibitors, hydrophilic film formers, and passivating agents.

The ceramic surface provided on the steel substrate is prepared by forming a slurry of monobasic phosphate solution with metal oxide particles and applying it to a clean surface to form a coating. This coating is fired at a temperature of at least 450° F. (230° C.), preferably at least 500° or 550° F. (260° or 85° C.), to produce a textured ceramic coating of a phosphate glass.

The ceramic surface provided on the steel substrate is highly water receptive and has been shown to be at least as hydrophilic as the oxidized surface of a conventional anodized aluminum substrate. The surface provides excellent adhesion for polymeric and oligomeric compositions. The surface has been found to provide particularly excellent adhesion for positive acting photosensitive compositions such as those containing diazo oxides and diazo sulfides, and provides good resistance to the developing solutions used which are generally highly alkaline.

The thickness of the ceramic coating can readily be varied as desired, for example, between 0.2 and 15 micrometers. Preferably, for use as a substrate for planographic printing plates, the coating layer is between 0.3 and 10 micrometers and more preferably is between 0.5 and 5 micrometers.

The particulate matter added to the monobasic phosphate to form a slurry may have a considerable range and constitute substantially any non-metallic inorganic particle. By non-metallic, it is meant that the particle should not have such a high proportion of free metal (greater than 25% by weight on the surface) as would interfere with lithographic compositions.

This may comprise non-metallic particles, especially metal oxide particles, embedded in a vitreous, water resistant phase or phases of a dehydration product of monobasic phosphates such as those of aluminum and/or magnesium, alone or in combination with the products of their reaction with some or all of the particles. Other monobasic phosphates which are acceptable include those of zinc, calcium, iron and beryllium. When the metal oxide is alumina, the bonding phase between the phosphate glass and the alumina is most likely aluminum orthophosphate.

By the term 'particulate,' as used in the practice of the present invention, it is understood that particles within a broad size range are useful. Particles small enough to form colloidal dispersions, e.g., as small as average sizes of $5\times10^{-3}$ micrometers and preferably no smaller than $1\times10^{-3}$ micrometers are quite useful, as are some others, up to 45 micrometers. The preferred size range is between $10^{-2}$ and 45 micrometers, and the most preferred range is between $10^{-2}$ and 5 micrometers. If highly reactive particles are used, they will in effect dissolve away (in whole or in part) by reaction of material from the surface of the particle. Thus, surprisingly large particles can be used which would not interfere with the physical properties of the surface. Agglomerated particles having a large agglomerate size which can be broken down during processing may also be used.

The metal oxides, for example, may include alumina (in various phases such as alpha, beta, theta, and gamma alumina), chromia, titania, zirconia, zinc oxide, stannous oxide, stannic oxide, beryllia, boria, silica, magnesium oxide, etc. Certain oxides and even certain different phases of the oxides or mixtures thereof perform better than others. For example, the use of mixtures of alpha alumina and certain reactive transition aluminas such as the theta and gamma alumina provides a surface having improved properties over that obtained with particles of a single alumina phase. The presence of the alpha phase in the slurry provides a ceramic coating with increased wear resistance and the presence of the other phases, or other metal oxide particles, tends to provide a more finely textured surface than alpha alumina by itself. By 'reactive' it is meant that the oxide reacts with monobasic phosphate during firing conditions.

Particulate materials which react with the acid or monobasic phosphate give more alkali-resistant binder compositions. When such materials are added in excess of the amount that will react fully with phosphate, they may additionally contribute to the surface texture of the fired coating. If they are in a form that reacts slowly or not at all at room temperature, they may contribute to the consistency or viscosity of the slurry, giving a formulation that may be particularly well-adapted for particular coating methods. Furthermore, some of these materials detract from or add to the hydrophilicity of the phosphate coating in a controlled way. In summary, then, there can be added to the slurry a blend of reactive, fine, particulate materials that maximize resistance to alkaline attack, optimize slurry consistency for the slurry solids fraction and the particular coating process, and give the hydrophilicity and microtexture that are most compatible with the intended image coating system.

A reactive inorganic material most desirably present is a magnesium compound. Magnesium carbonate, magnesium oxide, magnesium hydroxide, and monomagnesium phosphate have been used, and the characteristic, desirable, contribution to alkali resistance was obtained in each case. Zinc oxide, zinc carbonate or zinc phosphate could be substituted for the magnesium compound, though slightly poorer alkali resistance was obtained with the zinc compounds than with the magnesium compounds.

The amount of magnesia, i.e., magnesium oxide or magnesium hydroxide, generally added is not enough to yield a fully tribasic (dehydrated) phosphate composition upon firing, so additions of other materials supplying polyvalent cations will in general give further alkali resistance. Hydrated or transition aluminas, sols of many metal oxides, or blends of these materials, may be added, generally together with magnesia and generally in such proportions as to optimize the coating as noted above. The graded gamma-theta alumina designated "GB 2500" by its supplier, the Micro Abrasives Corp. of Westfield, Mass., the hydrated alumina "Hydral 710" supplied by the Aluminum Co. of America, the predominantly boehmite product, "Dispural", supplied by Condea Chemie GMBH, 2000 Hamburg 13, West Germany; the "Aluminum Oxide C" of Degussa Pigments Division, D-6000 Frankfurt 1, West Germany; and the alumina, chromia, yttria, zirconia, and ceria sols supplied by Nyacol Inc., Ashland, Mass., are examples of reactive materials useful in combination with the suggested magnesium compounds. This list is intended to be suggestive rather than exhaustive. Many other compounds are expected to be useful as reactive materials in the form of sols or fine powders: compounds such as titanium dioxide, calcium hydroxide, calcium oxide, calcium fluoride, or calcium phosphate, beryllium oxide, ammonium fluorotitanate, and tungstic oxide are suggested by the literature as useful constituents of phosphate glasses.

The resulting fired slurries tolerated moderate levels of alkali metal oxides, such that commercial or technical grades of materials are generally acceptable; however, compounds containing major amounts of alkali metal cations are not recommended. When silica sol is added, compensating extra metallic oxide should also be added to optimize alkali resistance.

In addition to reactive inorganic particulate materials or some blend thereof, particles of hard, wear-resistant materials may be added with good effect. In general these are expected to react only superficially with the phosphate bonding material, and not to contribute substantially to insolubilization. Graded alpha alumina of the type of "381200 Alundum", supplied by the Norton Co. of Troy, N.Y., or "WSK 1200" write alumina supplied by Treibacher GMBH of Treibach, Austria, and various grades of "WCA" alumina supplied by Micro Abrasives Corp., are useful. It is necessary to burn off organic contaminants, as by kiln firing, from some of these materials. Graded tin oxide supplied by Transelco, Inc. of Penn Yan, N.Y., was substituted for or blended with alumina in several proportions without loss of properties. Graded fine sands of other hard materials such as quartz, amorphous silica, cerium oxide, zirconia, zircon, spinel, aluminum silicate (mullite), and even hydrophobic particles such as silicon carbide, among many others, would be expected to function satisfactorily, though perhaps (as compared to alumina) to have less attractive cost or availability as closely-sized powders. It is preferred to use hydrophilic particles in the practice of the present invention, and especially metal oxides.

These hard particles contribute wear resistance and coarse roughness to the fired coating. The amount and size to be added depends on development of optimum compatibility with the desired image coating system, to the extent such compatibility depends on coarse roughness, measurable as "Arithmetic Average Roughness" using a profile measuring instrument. Examples of such instruments are the Federal Products Corp. (Providence, R.I.) "Surfanalyzer", and the Bendix Co. (Ann Arbor, Mich.) "Proficorder".

It is well known that different lithographic substrate texturizing processes and the variation of conditions within these processes provide different ranges of arithmetic average roughness and different combinations of arithmetic average roughness and specific surface area. The optimum combination of these characteristics depends upon the type of use to which the final lithographic plate is subjected and the particular photosensitive composition applied thereto. Important characteristics to be considered with regard to selecting combinations of these characteristics with specific photosensitive compositions include the mechanical adhesion and release properties (e.g., developability) of the imaged coating. By adjusting the size, type, fraction, and mix of particles in the coating composition, the coating process of the present invention can provide substrates over most of the range of roughness and specific surface areas produced by all of the prior art processes.

The firing temperatures used in the practice of the present invention must be higher than 450° or 500° F. (230° or 260° C.) and preferably are at least 550° F. (285° C.). Temperatures higher than 700° F. (370° C.) can be used to advantage with steel substrates. The need for precise temperature control is not as important with steel substrates as with aluminum substrates. These temperatures refer to the surface temperature of the coating, measured by contacting the coating surface with the bare junction of a thermocouple. It will be understood that many different types of ovens having a variety of control characteristics may be used for achieving the required surface temperatures. The control temperature may in fact differ substantially from the surface temperature measured in the manner described above.

The firing should be performed for a long enough time at these temperatures to insure substantially complete dehydration of the coating. This may take place in as little time as three seconds at the described temperatures depending upon the thickness of the coating and the temperature and other parameters of the firing process. The ceramic surface may be further treated as by etching to provide particularly desired textures and properties to the surface, but the surface resulting from the firing already is textured. This optional treating is not critical or essential to the present invention and is most generally performed in conjunction with imaging systems (e.g., lithographic printing plates) which are optimized by a silicate treatment of the substrate or some other analogous layer. For example, etching can be accomplished by using known alkaline silicate solutions which will deposit a silicate coating at the same time. Where no silicating is required or where the subsequently applied light sensitive composition would not be compatible with a silicate surface, the etch may be performed in alkaline phosphate or aluminate solutions, for example. The substrate may initially have a texturized surface so that etching of the ceramic coating will expose the texture through the ceramic coating. This is unnecessary, however, in the practice of the present invention because of the natural texture produced in the process. This natural texture, which is a microscopic texturing visible by light scattering or under magnification, provides a physical structure to which subsequently applied light sensitive coating compositions may adhere.

The optional post-firing etch may remove whatever amount of the dehydrated ceramic coating is necessary to provide the character required in the texture of the substrate. As little as five percent and as much as sixty percent by weight or more of the ceramic coating may be removed. The length of time of the etch is regulated by the temperature and pH of the etching environment. Higher temperatures and higher pH levels provide faster etches. The pH may be controlled by the addition of alkaline hydroxides such as sodium hydroxide. Replenishing solutions may be added during the continuous processing operation to replace any material, such as the alkali component, which is depleted during the etch. The combined etch and silicating solutions are generally optimized to emphasize the silicating treatment, since the silicate etch has a wider performance latitude than phosphate or aluminate etching solutions. The silicates used for the combined etching and silicating baths are preferably at the high silica content end of the commercially available materials. Such materials as "Kasil #1" or S-35" of the Philadelphia Quartz Co. or mixtures of "S-35" with a fine silica sol (e.g., Sol #1115 of Nalco Chemical Co.) are particularly useful when diluted with water to give solutions having approximately one percent silica on a dry weight basis.

The texturized substrates produced on the ceramic coated steel substrate by the firing step may then be coated with a light sensitive composition either directly or with an intermediate sublayer. An oligomeric diazonium resin and/or an organic negative or positive acting photosensitive composition may be desirably applied to the textured surface.

It should be noted that one can practice the present invention by forming monoaluminum phosphate or other acid phosphates in situ during the firing step. This can be accomplished, for example, by coating a slurry of phosphoric acid and a stoichiometric excess of reactive alumina onto the surface to be fired. Aluminum phosphate is generated during the initial firing period, and with a stoichiometric excess of alumina present, reactive alumina particulate material will remain in the reactive composition during the continued firing. This is sufficient to provide coatings according to the present invention, and the formation of monoaluminum phosphate or other aluminum phosphates or mixed phosphates of aluminum and other metals in situ is contemplated as being within the scope of practicing the present invention.

In addition to the foregoing in situ formation by reaction of excess metal oxide or hydroxide with phosphoric acid, it is also possible to form monoaluminum phosphate in situ or mixed phosphates of aluminum and other metals in situ by reacting stoichiometrically equivalent amounts of reactive alumina, i.e., aluminum oxide or aluminum hydroxide, with either phosphoric acid or an alkaline earth acid phosphate such as monomagnesium phosphate solution. The interchangeability of monoaluminum phosphate with a reaction mixture containing alumina and phosphoric acid or an alkaline earth acid phosphate is shown by the following equivalences:

$$3Ca(H_2PO_4)_2+Al_2O_3=2Al(H_2PO_4)_3+3CaO$$
$$3Mg(H_2PO_4)_2+Al_2O_3=2Al(H_2PO_4)_3+3MgO$$
$$Al(OH)_3+3H_3PO_4=Al(H_2PO_4)_3+3H_2O$$
$$Al_2O_3+6H_3PO_4=2Al(H_2PO_4)_3+3H_2O$$

The foregoing reactions are not necessarily of practical significance.

Further, alkaline earth acid phosphates may be created in solution by mixing an appropriate alkaline earth tribasic phosphate with phosphoric acid. For example, $$Ca_3(PO_4)_2+4H_3PO_4=3Ca(H_2PO_4)_2$$
$$Mg_3(PO_4)_2+4H_3PO_4=3Mg(H_2PO_4)_2$$
$$Mg_3(PO_4)_2+H_3PO_4=3MgHPO_4$$

The following reactions demonstrate the processes which create orthophosphates during firing with phosphoric acid and/or a suitable acidic phosphate starting material:

$$2H_3PO_4+Al_2O_3\rightarrow 2AlPO_4+3H_2O$$
$$Al(H_2PO_4)_3+Al_2O_3\rightarrow 3AlPO_4+3H_2O$$
$$Al(H_2PO_4)_3+3MgO\rightarrow AlPO_4+Mg_3(PO_4)_2+3H_2O$$
$$3Mg(H_2PO_4)_2+2Al_2O_3\rightarrow 4AlPO_4+Mg_3(PO_4)_2+6H_2O$$
$$6Ca(OH)_2+3Mg(H_2PO_4)_2\rightarrow 2Ca_3(PO_4)_2+Mg_3(PO_4)_2+12H_2O$$

It has been found that addition of calcium-containing inorganic compounds to the slurry reduces the necessity for close monitoring of the firing temperature, by providing a mixture that is effectively dehydrated at somewhat lower temperatures or shorter times. The calcium addition is preferably in the form of calcium hydroxide, calcium carbonate, calcium oxide, calcium phosphate, or mixtures thereof. To achieve this useful result it is also desirable to add the magnesium-containing compound as a soluble phosphate and the aluminum-containing compound in an ultrafine and/or dissolved condition.

It has also been found that addition of calcium-containing inorganic compounds to the slurry contributes to a coating composition that may be fired at a lower temperature or in less time, while retaining lithographic quality at greater coating thicknesses than previously possible. The aluminum-containing compound may be a fumed alumina, e.g. that produced by flame hydrolysis of anhydrous aluminum chloride, having mean ultimate particle diameter less than 20 nanometers. When all the constituents which are required to react to form an intimately dispersed, uniform phosphate phase are in the most rapidly reactive forms currently available as chemical raw materials, better functional properties at the lower firing times and/or temperatures are obtained. It should be noted that too great a stoichiometric excess of reactive cation-supplying materials over anion supplying materials, i.e. phosphate and silicate, tends to weaken the coating mechanically, giving less abrasion resistance of the type described by ANSI-ASTM tests C501-66 and D1044-76, or a test combining some of the features of each of the two standard tests.

The slurries or solutions generally contain between 85 and 95% (by volume) of material that is volatile upon firing, the actual amount being that required to yield a satisfactory coating weight and satisfactory coatability with the chosen coating technique. A mixture of 50% aqueous monoaluminum phosphate solution with an equal weight of water, falls easily in this range, as do slurries which contain a greater number of additives. The volatile material is generally water, although water-miscible volatile liquids such as alcohols may be added in substantial part. The volume of volatile material stated above includes both the volatile material added as solvent or diluent, and that generated by reactions such as pyrolysis of organics or acid-base metathesis.

The second largest constituent of the slurries or solutions, which constituent may or may not be present, is a form of hard particles, such as the alpha aluminas mentioned previously. These may comprise between zero and 65% of the volume of the non-volatile portion. The size, shape, volume and type of hard particles is varied as needed to accommodate the intended specific use of the ceramic-coated material. A coating containing more than 65% hard particles by volume will be too lean in binder material with the result that the hard particles will not be securely bonded, and the voids between them may tend to trap ink in areas required to remain free of ink when the coating is used as a lithographic substrate. A fired film containing 45–60% by volume hard particles is dominated by relatively coarse features. This type of surface is desirable for use with some image coatings. Fired films containing less than 50% by volume hard particles may have their surfaces increasingly dominated by ultrafine features, because the relative volume of hard particles declines, while the relative volume of ultrafine particles increases. The ultrafine features are more desirable for use with some image coatings. Sedimentation and agglomeration of hard particles may be a source of coating problems. Where a formulation is required wherein the main characteristic is ease of coating with simple apparatus, the reduction of the volume of, or the complete elimination of, the coarser particles may be preferable. The hard particles considered for use in this invention react so slowly with phosphate solutions that they are presumed to undergo negligible reaction during firing.

The remaining constituent of the slurry formulation is a matrix or bonding constituent. In the simplest form, phosphoric acid alone may be coated and fired; however, useful properties are enhanced by using acid phosphates, such as monoaluminum phosphate, and/or reactive particles, such as alumina.

Greater chemical resistance than can be obtained with a coating derived from phosphoric acid employed by itself is essential or at least preferred. To obtain greater chemical resistance, reactive particles which yield metal ions should be added to the phosphate solution in quantities sufficient that an orthophosphate or mixture of orthophosphates is created upon firing.

Where the reactive particles are of a chemical species which yield calcium ions, a quantity ranging from about 0 to about 20% of the amount that would combine with the available phosphate ions to give calcium orthophosphate is used. Calcium additions in excess of 20% result in coagulation of the slurry, and are likely to result in a decline in acid resistance of the final article. Quantities in the range of about 4 to about 7% give the maximum reduction of firing temperature with no noticeable degradation of acid resistance or slurry viscosity. A solution of monocalcium phosphate, rather than particles which yield calcium ions, may be used to provide the calcium content.

Where the reactive particles, or other reactive material, are of a chemical species which yield magnesium ions, a quantity ranging from about 0 to about 35% of the amount that would combine with the available phosphate to give magnesium orthophosphate, is used. Quantities in the range of about 10 to about 20% are preferred. Where magnesium-containing particles are added at a level greater than 35% to monoaluminum phosphate, the resulting coating was found to flake away from the steel substrate upon cooling down from the firing temperature. Amounts of magnesium at lower than the 10% level are found to provide a less than optimum contribution to alkali resistance. Commercial monomagnesium phosphate solution, containing 5.3% MgO and 32.6% $P_2O_5$ by weight, may be used to provide magnesium ions since the amounts of magnesium and phosphate provided by this solution, with no other phosphate addition, give a magnesium ion addition of 19.1% of the amount required to yield magnesium orthophosphate.

Reactive particles yielding aluminum ions may be added in quantities ranging from about 0 to about 200% of the amount which, in combination with all other metal and phosphate ions present or liberated during firing, would give stoichiometric orthophosphate. The preferred range is 100–150%. For example, if the quantity of calcium-containing material in the phosphate solution slurry were 5% of the amount that would give calcium orthophosphate, and if the quantity of magnesium-containing material in the phosphate solution slurry were 15% of the amount that would give magnesium orthophosphate, then the preferred amount of aluminum ion-containing material to be added would be in the range of 80–130% of the amount that would yield aluminum orthophosphate. If another reactive cation were present, sufficient additional aluminum ion would have to be provided in excess of the 100–150% orthophosphate level to form the other reactive cation's orthocompound for the preferred compositions (e.g., if the other cation were silica, then sufficient additional aluminum ion-containing material would have to be provided to form aluminum orthosilicate). Aluminum contents below 100% result in coatings lacking chemical resistance, and aluminum contents above 150%, in combination with a typical loading of hard particles, result in decreased wear resistance of the coating. The excess of unreacted fine particles have utility as a filler or flatting agent, imparting a useful microtexture or chemical character to the surface of the fired film. It is conceivable that the total fine aluminum reactive particle content could be raised into the 150–200% range, with the resulting improvement in anchorage for the overcoated material compensating for the loss of basic abrasion resistance.

Dispersants such as gluconic acid may also be added to the slurry. Alkaline dispersants such as sodium tripolyphosphates are not preferred even though they do not destroy the function of the present invention. Pretreatment of the coarsest particles as with colloidal silica, may make the resulting slurries more stable against sedimentation.

Lithographically useful compositions may, of course, be coated on the ceramic surface. Such compositions would comprise (1) oligomeric diazonium resins, (2) positive acting diazo oxides or esters, (3) photopolymerizable organic compositions (particularly such as ethylenically unsaturated materials in the presence of free radical photoinitiators), (4) oligomeric diazonium resin undercoats with photopolymerizable organic composition overcoats, and (5) any other various well known lithographically useful photosensitive compositions.

The types of photosensitive coatings useful in the practice of the present invention are those which would ordinarily be considered for use in the printing plate art, and specifically, lithographic and relief compositions. These compositions would include both negative and positive acting lithographic compositions and negative acting relief compositions.

Negative acting compositions ordinarily perform by having a photopolymerizable composition which becomes less soluble and/or more highly polymerized when struck by actinic radiation in an imagewise pattern. This is ordinarily accomplished by have a mixture of materials including such various ingredients as binders, polymerizable materials (monomers, oligomers and polymers), photoinitiator catalysts for the polymerizable materials, sensitizers for the photocatalysts, and various other ingredients such as oleophilicity enhancers, pigments, surfactants, coating acids and other ingredients known in the art. After imagewise exposure to actinic radiation, the unreacted, more soluble areas of the coating composition are removed by washing with various solvents including water, aqueous alkaline solutions and organic developers. Amongst the most common materials used in the formation of negative acting lithographic printing compositions are ethylenically unsaturated monomers and photoinitiated free radical generators.

Organic and methacrylic polymerizable materials are the most frequently utilized components, but all other ethylenically unsaturated materials and copolymerizable ingredients are useful and known in the art. See, for example, U.S. Pat. Nos. 4,316,949, 4,228,232, 3,895,949, 3,887,450 and 3,827,956.

Positive acting lithographic compositions ordinarily comprise a binder of thermoplastic or partially cross-linked compositions which contain a positive acting photosensitizer which, when struck by light, becomes more soluble in selected solvents than the non-light exposed sensitizer. The most common photosensitizers used in the art are o-quinone diazide compounds and polymers. Various binders such as acrylic resins, phenol formaldehyde resins (particularly novolaks), polyvinyl acetal resins, and cellulosic esters are also generally known in the art for use with this type of photosensitizer. See, for example, U.S. Pat. Nos. 4,193,797; 4,189,320; 4,169,732 and 4,247,616.

Negative acting relief compositions work in similar fashion to negative acting lithographic systems, except that the layers are considerably thicker and that molds and embossing are often used to impress the surface structure when forming the relief image.

The following examples, which are illustrative rather than limiting or delineative of the scope of the invention, serve to described the novel photosensitive article of this invention.

EXAMPLES

In the examples which follow, two types of steel sheet material and three types of steel sheet precleaning methods were utilized. The types of steel sheet material are as follows:

Plain steel is tin mill black plate, double reduced, as described by ASTM Standard A 650-83 or A 650 M-83. It is a low-carbon, low-alloy-content steel. Upon being cleaned, it yields a surface that, with respect to its utility as a substrate for a lithographic ceramic coating, is typical of that of most ordinary low-alloy content steels. Tin mill products in general are specified by ASTM Standards A 623-83 and A 623 M-83, singly reduced black plate by ASTM Standard A 625-76.

Tin-free steel is tin mill black plate electrolytically coated with chromium and chromium oxide, as described by ASTM Standard A 657-81. It is a plain low-alloy steel that has been given a very thin electrolytic chromium coating at the mill. Following that cathodic treatment whereby the chromium coating is deposited, the sheet material is anodized for a short period of time in the plating bath to produce a surface layer of chromium oxide, which improves the coatability and coating performance of inks and lacquers. This bulk chromium oxide layer is quantitatively removed prior to coating by the pre-cleaning process described herein, though a surface film of molecular thickness is certain to reform. Ordinary steel having a surface film of chromium oxide is analogous to stainless steel, which is an alloy containing at least 12 weight percent chromium. The stainless steel surface is enriched in chromium beyond 12% by the tendency of the chromium atoms to diffuse out of the bulk material and become concentrated at a free surface, and by the passivation process, wherein iron is selectively dissolved from the surface, leaving an essentially iron-free surface layer.

Each steel specimen was cleaned of the protective oil applied at the mill and treated with a composition known to promote coherence and adherence of ceramic coatings during the firing step.

Three different cleaning solutions were used. The first consisted of 45.0 g sodium hydroxide (NaOH), 2.5 g ethylene diamine tetraacetic acid (EDTA), and 10.5 g of Onyx Chemical Co. "Maprofix WAC-LA" solution (a 30% aqueous solution of the surfactant dodecyl sodium sulfate plus a hydrotrope) per liter of deionized water. The second was identical except that the sodium hydroxide was omitted and in its place was added 119.25 g sodium silicate pentahydrate ($Na_2O.SiO_2.5H_2O$), per liter deionized water. This gives the same sodium ion concentration as was present in the first composition.

The third composition had the same surfactant, complexing agent, and silicate levels as the first two, but the sodium ion concentration was reduced by one third by substituting 64.2 g Philadelphia Quartz Co. "Star Brand" sodium silicate solution, per liter of deionized water, for half the silicate of the second formulation.

Each of the steel specimens was immersed in one of the three cleaning solutions for 2 min. at 80°-90° C., then rinsed for 30 seconds in a deionized water spray. The second and third cleaner formulations left a silicate residue on the cleaned specimens. Where a non-silicate or different silicate treatment was desired, the first cleaner composition was used.

The following table sets forth the ingredients of the composition for preparing the ceramic coating and the amounts of each ingredient.

| Ingredient | Amount Percent by Weight |
|---|---|
| Methanol | 13.7 |
| Deionized water | 51.48 |
| "Nalcoag 1115" silica sol (Nalco Corp.) | .34 |
| Gluconic acid, 50% Aq. | .33 |
| Grade 1200 "#38 Alundum AWIF" alumina (Norton Co.) | 11.44 |
| "Aluminium Oxide C" alumina (Degussa Corp.) | 3.13 |
| "GB-1200" alumina (Micro Abrasives Corp.) | .44 |
| Calcium hydroxide | .64 |
| Monomagnesium phosphate solution (Mobil Chemicals Co.) | 14.58 |
| Monoaluminum phosphate solution (Mobil Chemicals Co.) | 3.91 |

Individual sheets were roll coated with a textured coating roll rotating on its axis at the same angular speed and opposite sense as a rubber support roll on a parallel axis. Many conventional roll and slot coating methods have been found to work well.

Coated sheets were fired individually in a convection oven at an air temperature of 800° F. for 2 minutes, then immersed in a 95° C. solution of 7 wt. % Philadelphia Quartz Co. "Star Brand" sodium silicate solution, balance deionized water, for 2 minutes, then rinsed 30 seconds in a deionized water spray at room temperature. After drying they were hand coated with a negative-working, light-sensitive coating, exposed, developed, and prepared for testing on press. The following table sets forth the results of the lithographic plates of this invention.

TABLE

| Example No. | Cleaner | Pre-coating treatment | Adhesion of ceramic coating | Printing performance |
|---|---|---|---|---|
| 1 | 1 | None | None | Not tried |
| 2 | 2 | None | Excellent | Very good |
| 3 | 3 | None | Excellent | Very good |
| 4 | 1 | 7% "Star" silicate, rinse | Excellent | Very good |
| 5 | 1 | 5% $NaNO_2$, rinse | Excellent | Very good |
| 6 | 1 | 5% $Na_2SnO_3$, no rinse | Good | Fair |
| 7 | 1 | 5% $Na_2MoO_4$, no rinse | Good | Fair |
| 8 | 1 | 5% $Na_2WO_4$, no rinse | Good | Fair |
| 9 | 1 | 5% $K_2Cr_2O_7$, no rinse | Good | Unsatisfactory |
| 10 | 1 | 5% $KMnO_4$, rinse | Excellent | Very good |
| 11 | 1 | 5% $CrO_3$, rinse | Good | Unsatisfactory |
| 12 | 1 | 10%, 50% monoaluminum phosphate solution, no rinse | Fair | — |
| 13 | 1 | Cr electroplate (Tin-free steel), no further treatment | Excellent | Very good |
| 14 | 2 | Same as 13 | Excellent | Very good |
| 15 | 3 | Same as 13 | Excellent | Good |
| 16 | 1 | Same treatments as in Lots 4–12, above, applied to tin-free steel | Good | — |

The preferred treatments for filming plain steel prior to ceramic coating were cleaner compositions 2 or 3, plus rinsing, and no further treatment; or chromium coating (tin-free steel), with cleaning in solutions 1 or 2, rinsing, and no further treatment.

As noted above, rinsing subsequent to the inorganic-filming or passivating treatment is not necessary in some cases, but is preferable, with functioning treatments. A functioning treatment produces a reaction layer that survives conventional spray rinsing for 30 seconds in tempered (90°–100° F.) deionized water sprays. Excess treatment material such as is left by drying the treatment without rinsing, tends to contaminate the ceramic layer, sometimes with an adverse effect on the subsequently applied photosensitive layer. This is particularly noticeable with the chromate, dichromate, and chromic acid treatments, which impart excellent ceramic properties, but detract from the developability of the subsequent photosensitive coating even when rinsed. The use of adequate rinsing and a non-interfering treatment is preferred in quantity production. While all substrates were coated with conventional diazo-based photosensitive layers and evaluated for the adherence and quality of lithographic image upon exposure and development, it was determined tht any of the listed treatments, perhaps with some modification, would give lithograhic printing plates of commercial quality. The preferred treatments, described in the above tables as providing "Excellent" ceramic properties and "Very Good" printing performance, gave lithographic plates having image quality and wear life equivalent to state-of-the-art texturized and anodized aluminum plates having similar image coatings. Treatments less highly rated are sufficiently good to present commercial possibilities, perhaps with additional modifications. Upon press conditions expected to give cracking or tearing of aluminum plates, the steel plates would have greater wear life than aluminum.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A photosensitive article comprising:

A. A tin-free steel or stainless steel substrate in the form of a film or sheet, B. a hydrophilic ceramic layer and adhered to said substrate and comprising (1) non-metallic inorganic particles and (2) a water-resistant phase, or phases, of a dehydration product of at least one monobasic phosphate , said ceramic layer having a thickness between 0.2 and 15 micrometers, and C. a photosensitive lithographic coating coated over said ceramic layer.

2. The photosensitive article of claim 1 wherein said substrate is as specified by ASTM Standards A 657-81.

3. The photosensitive article of claim 1 wherein a composition comprising an oligomeric diazonium resin is coated on said ceramic layer.

4. The photosensitive article of claim 1 wherein the ceramic layer further comprises the reaction product of said at least one monobasic phosphate with said particles.

5. The photosensitive article of claim 1 wherein said particles comprise metal oxide particles having an average size of from $1\times10^{-3}$ to 45 micrometers.

6. The photosensitive article of claim 5, wherein said lithographic coating comprises a polymerizable composition.

7. The photosensitive article of claim 5, wherein said ceramic layer has a thickness between 0.2 and 15 micrometers and said substrate is in the form of a film or sheet, and said lithographic coating comprises a positive acting o-quinone diazide in a polymeric binder.

8. The photosensitive article of claim 5, wherein said ceramic layer contains a reaction product of alumina with a monobasic phosphate and a reaction product of at least one oxide other than alumina with a monobasic phosphate, the orthophosphate of said at least one metal oxide being insoluble in an aqueous solution having a pH of from 6–12.

9. The photosensitive article of claim 5, wherein said particles are bound into an amorphous phase of aluminum phosphates formed by dehydration of monoaluminum phosphate.

10. The photosensitive article of claim 5, wherein said metal oxide particles comprises magnesia.

11. The photosensitive article of claim 5, wherein said metal oxide particles comprise alumina.

12. The photosensitive article of claim 11, wherein said ceramic layer has a thickness between 0.5 and 5 micrometers.

13. A photosensitive article comprising:

A. a substrate selected from the group consisting of tin mill black plate, tin-free steel, and stainless steel in the form of a film or sheet bearing on at least one surface thereof B. an adhesion promoting layer wherein the adhesion promoter is formed from an aqueous inorganic surface treatment composition, C. a hydrophilic ceramic layer adhered to said adhesion promoting layer and comprising (1) non-metallic inorganic particles and (2) a dehydration product of at least one monobasic phosphate , said ceramic layer having a thickness between 0.2 and 15 micrometers, and D. a photosensitive lithographic coating coated over said ceramic layer.

14. The photosensitive article of claim 13 wherein said substrate is as specified by ASTM Standards A 623-83, A 623M-83, A 625-76, A 650-83, A 650M-83, or A 657-81.

15. The photosensitve article of claim 13 wherein a composition comprising an oligomeric diazonium resin is coated on said ceramic layer.

16. The photosensitive article of claim 13 wherein the ceramic layer further comprises the reaction product of said at least one monobasic phosphate with said particles.

17. The photosensitive article of claim 13 wherein said particles comprise metal oxide particles having an average size of from $1\times10^{-3}$ to 45 micrometers.

18. The photosensitive article of claim 17, wherein said lithographic coating comprises a polymerizable composition.

19. The photosensitive article of claim 17, wherein said ceramic layer has a thickness between 0.2 and 15 micrometers and said substrate is in the form of a film or sheet, and said lithographic coating comprises a positive acting o-quinone diazide in a polymeric binder.

20. The photosensitive article of claim 17 wherein said ceramic layer contains a reaction product of alumina with a monobasic phosphate and a reaction product of at least one oxide other than alumina with a monobasic phosphate, the orthophosphate of said at least one metal oxide being insoluble in an aqueous solution having a pH of from 6–12.

21. The photosensitive article of claim 17, wherein said particles are bound into an amorphous phase of aluminum phosphates formed by dehydration of monoaluminum phosphate.

22. The photosensitive article of claim 17, wherein said metal oxide particles comprises magnesia.

23. The photosensitive article of claim 17 wherein said metal oxide particles comprise alumina.

24. The photosensitive article of claim 23 wherein said ceramic layer has a thickness between 0.5 and 5 micrometers.

25. The photosensitive article of claim 13 wherein the adhesion promoter is selected from the group consisting of rust inhibitors, hydrophilic film formers, and passivating agents.

* * * * *